US005802608A

United States Patent [19]

Earl

[11] Patent Number: 5,802,608

[45] Date of Patent: Sep. 8, 1998

[54] DESIGNATOR WAISTBAND FOR ATHLETES

[76] Inventor: Milan Dennis Earl, 345 E. Main St., Moorestown, N.J. 08057

[21] Appl. No.: 770,586

[22] Filed: Dec. 19, 1996

Related U.S. Application Data

[63] Continuation-in-part of Ser. No. 518,011, Aug. 22, 1995, abandoned.

[51] Int. Cl.[6] ..... A41F 19/00

[52] U.S. Cl. ..... 2/1; 2/311

[58] Field of Search ..... 2/311, 1, 312, 2/338, 48, 69, 314, 315, 317, 318, 321; 273/55 C; 116/173; 40/586, 318, 640

[56] References Cited

U.S. PATENT DOCUMENTS

| | | | |
|---|---|---|---|
| 2,846,224 | 8/1958 | Roselle | 2/321 X |
| 3,063,718 | 11/1962 | Steinkamp | 273/55 C |
| 3,089,143 | 5/1963 | Jacobson . | |
| 4,096,977 | 6/1978 | Barville et al. . | |
| 4,472,839 | 9/1984 | Johansen . | |
| 4,698,854 | 10/1987 | Slimmon . | |
| 4,819,846 | 4/1989 | Hannemann | 2/312 |
| 4,944,043 | 7/1990 | Bush . | |
| 5,052,055 | 10/1991 | Mysliwiec . | |
| 5,299,324 | 4/1994 | Zinna | 2/311 |

FOREIGN PATENT DOCUMENTS

| | | | |
|---|---|---|---|
| 350886 | 1/1961 | Switzerland | 2/1 |

OTHER PUBLICATIONS

"Gym Playground Equipment", Wolverine Co., p. 166, I.D. Aprons No Date.

Philadelphia Inquirer—Sep. 11, 1995; Photo showing a running apron.

"Sportime" Team Belts—p. 170; No Date.

Wolverine Co., p. 107—"Game Belts"; No Date.

*Primary Examiner*—C. D. Crowder
*Assistant Examiner*—Shirra L. Jenkins

[57] ABSTRACT

A device which improves the method for identifying athletes during sporting activities, particularly practices and physical education classes, comprised of a wide colored garment worn around the midsection of the participant. An elastic belt having cloth panels attached and hanging therefrom is pulled around the waist of the participant and fastened by means of hook and loop or other simple attachment. It provides freedom of motion when worn, while being easy to put on and remove. The highly visible surface area is nearly continuous and allows teachers, referees, participants, scorers, coaches, fans, and the like to differentiate between the various athletes.

1 Claim, 3 Drawing Sheets

DESIGNATOR WAISTBAND FOR ATHLETES

This document represents a continuation in part of patent application Ser. No. 08/518,011 filed Aug. 22, 1995, now abandoned.

BACKGROUND

1. Field of Invention

This invention relates to garments used to distinguish athletes from opponents and teammates during competition and instruction.

2. Description of Prior Art

Players of team sports necessarily need to distinguish between their teammates and the opposition in order to make rapid decisions during competion. Additionally, physical education teachers, coaches, scorers, referees, scouts, and onlookers must be able to make the same distinctions. Uniforms with numbers accomplish this task but are expensive and therefore unrealistic to use for practices, scrimmages, and informal games.

For such situations, pullover vest-like garments of a particular color are presently used. They are called "pinnies", probably short for pinafore, or they were initially designed to be pinned to the shirt of the user. These pinnies typically are uncomfortable, tend to acquire perspiration and odor rapidly, are difficult to take off and put on quickly, and occasionally impede the free movement of the upper body and arms of the user. For these and a variety of other reasons, they are generally disliked by athletes.

Because there have been no viable alternatives to these pinnies, they have become a common item in athletic programs for use in team sports at all levels. Pinnies have also become relatively expensive, considering the complexity of their construction and the fact that they are worn so often that they must be replaced on a regular basis.

The cited prior art falls short of the scope, design and intent of the instant application. Swiss Patent No. 350886 shows an arm band which is used to direct by means of an arrow deign on the band. It has neither the surface area nor the purpose of an identification device, instead it is used to direct after the wearer has been located.

U.S. Pat. Nos. 2,846,224, 3,063,718, 4,819,846, and 5,299,324 all have different purposes than designation. They do not present the visual capability of a large-surfaced designator if used within the context of their intended purposes. Items such as flag football belts, although they may be constructed with bright coloration, merely serve to prove whether a tag has been made and would necessarily have to be dramatically changed in design to accomodate the purpose of identification of teammates.

OBJECTS AND ADVANTAGES

Several objects and advantages of the invention are:

a) to provide a designator which is readily visible from all angles of view.

b) to provide a designator which is comfortable when worn c) to provide a designator which does not interfere with the movement of the user d) to provide a designator which is quickly and easily attached to and detached from the wearer.

e) to provide a designator which is inexpensively and simply constructed f) to provide a designator which will be worn in a manner which will minimize the absorption of perspiration.

g) to provide an inexpensive alternative to uniforms for use in tournaments and leagues.

Still further objects and advantages will become apparent from a consideration of the ensuing description and drawings.

DRAWING FIGURES

DESCRIPTION

Figure 1:
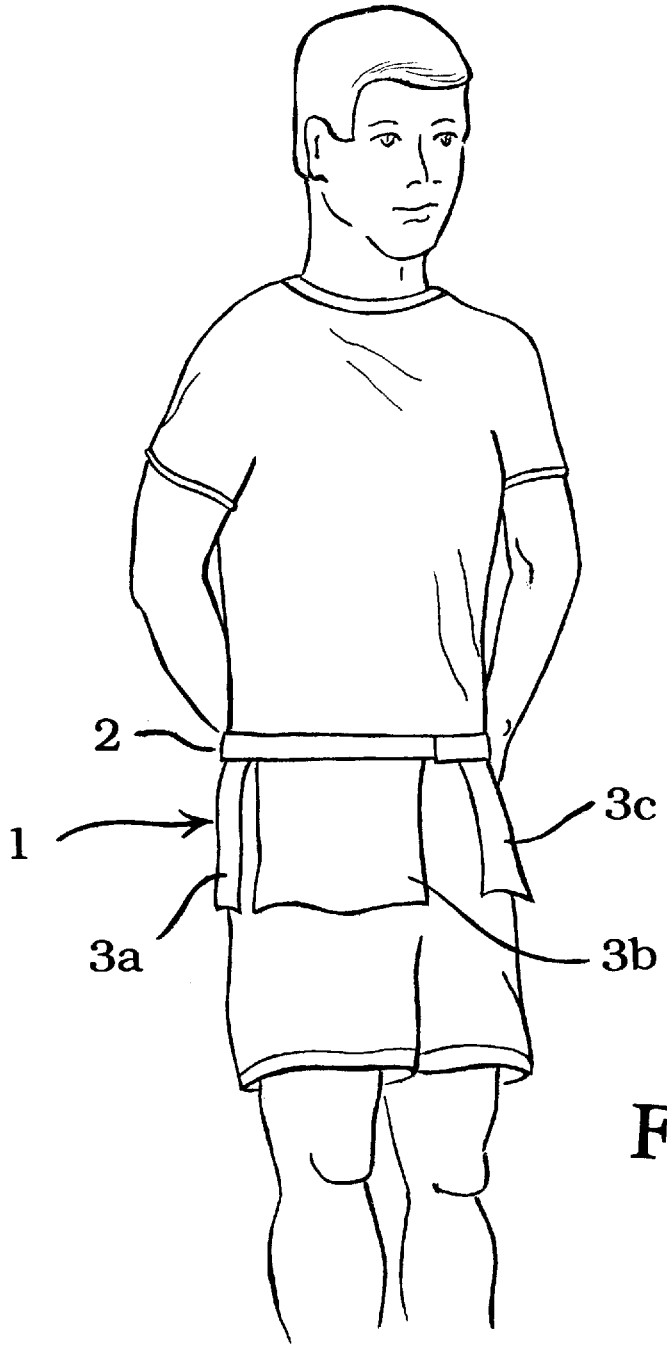
FIG. 1 shows an athlete wearing a designator
Figure 2:
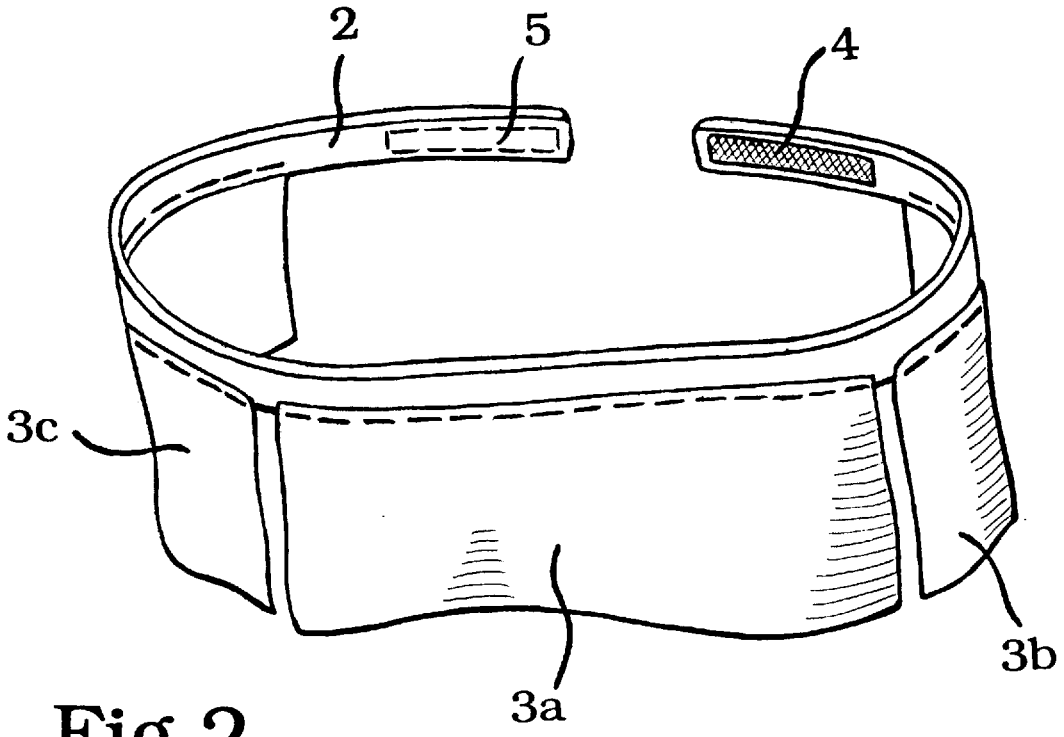
FIG. 2 shows a designator having three clothlike pieces

A typical embodiment of the invention is illustrated in FIGS. 1 and 2. As shown in FIG. 1, Designator 1 is constructed of an elastic belt 2 made from a clothlike material and from which is suspended three separate clothlike sections 3*a,* 3*b,* and 3*c.* Sections 3*a,* 3*b* and 3*c* are of the same bright color for the purpose of easy identification. The clothlike material may be chosen from a group of lightweight fabrics or plastic sheeting.

Sections 3*a,* 3*b,* and 3*c* are spaced along elastic belt 2 in such manner as to present a large surface area, virtually continuous, in order to be visible from any angle relative to the wearer. The large, substantially continuous surface area also makes it easy for teammates to be recognized through the use of peripheral vision. The corners of the rectangular sections may be rounded or angled without significant visibility loss in order to aesthetically improve the garment.

Each section is connected to elastic belt 2 in a manner, such as sewing to a prestretched belt, that allows for significant expansion and contraction of elastic belt 2, thereby insuring a comfortable fit for a large range of waist sizes.

Hook material 4 and loop material 5 provide means by which elastic belt 2 is rapidly and firmly connected and disconnected. An alternative method of connection, such as plastic closures could serve the same purpose.

In order to wear a designator, the athlete need only stretch elastic belt 2 around his or her waist, then connect hook material 4 with loop material 5. Elastic pressure thereafter holds the designator in place around the midsection of the body.

Figure 3:
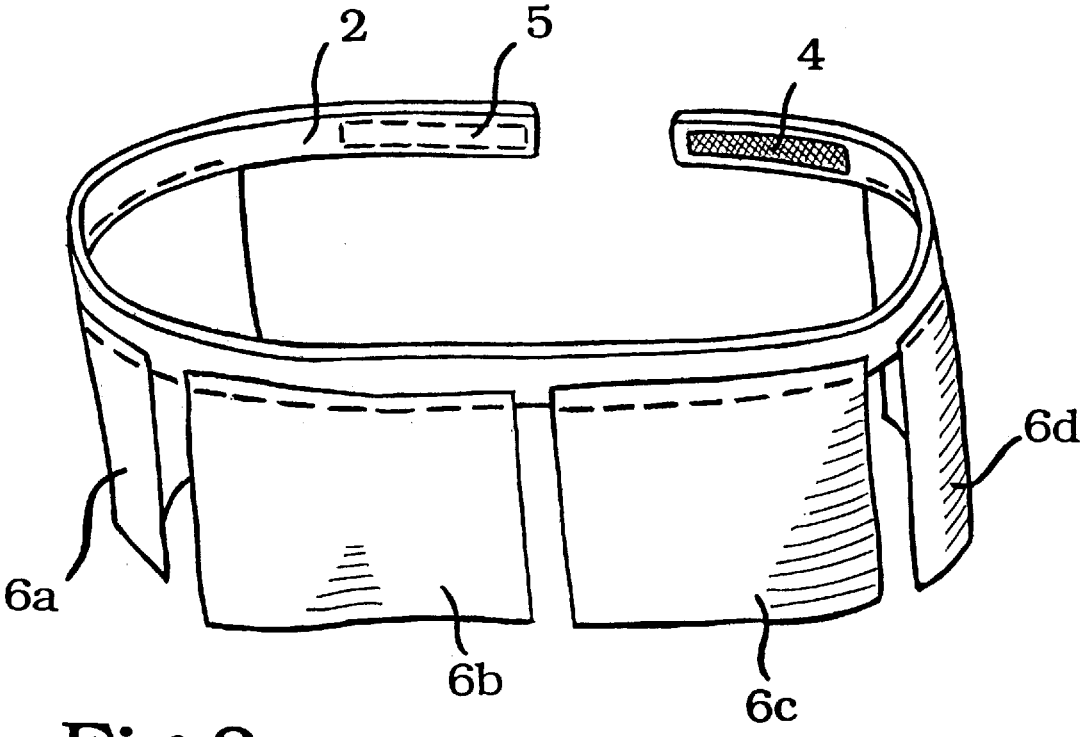
FIG. 3 shows a designator having four clothlike pieces

A further embodiment is pictured in FIG. 3. Therein, clothlike sections 6*a,* 6*b,* 6*c,* and 6*d* present a similar visually continuous surface area to the viewer. A determination of the ideal number of clothlike sections would be based on comfort and appearance considerations.

SUMMARY, RAMIFICATIONS, AND SCOPE

Accordingly, the reader will see that the designator provides a comfortable device in which members of a particular athletic team, and individuals on that team, may be distinguished.

Sports such as basketball, football, soccer, field hockey and the like may use designators during instruction, practices, scrimmages, and games. This invention provides an inexpensive alternative to both game uniforms and pinnies.

Many alternative embodiments are possible for the designator, such as:

a) Increasing or decreasing the number of sections.

b) Providing numerals or other identifying symbols on the garment for statistical purposes.

c) Utilizing other means to connect the elastic belt, such as snaps, buttons, ties and the like.

d) Fabricating the elastic belt such that it is a continuous band which is pulled up in much the same manner as pants.

e) Using the surface areas of the designator for commercial advertising.

f) Using designs, in addition to colors, to provide variety.

g) Using different colors on the reverse sides of the designator, so that two teams may have separate colors.

Although the descriptions above contains many specificities, these should not be construed as limiting the scope of the invention but as merely providing illustrations of some of the presently preferred embodiments of this invention.

I claim:

1. An article of clothing worn around the waist comprising:

an elastic belt having mateable fastening means on each end;

a plurality of separate clothlike pieces substantially rectangular in shape and connected to said elastic belt in a manner as to allow for reasonable expansion and contraction of said elastic belt;

said clothlike pieces spaced along said elastic belt in such a manner as to be visible from any angle relative to the wearer;

and said clothlike pieces spaced along said elastic belt in such a manner as to substantially present a wide continuous visible surface to the viewer.

* * * * *